United States Patent [19]

Johnson

[11] Patent Number: 4,538,922

[45] Date of Patent: Sep. 3, 1985

[54] PORTABLE MIXING DEVICE

[76] Inventor: William H. Johnson, 1941 Karlin Dr., St. Louis, Mo. 63131

[21] Appl. No.: 627,115

[22] Filed: Jul. 2, 1984

[51] Int. Cl.[3] ..... B01F 7/00; B01F 7/24; B01F 15/00

[52] U.S. Cl. ..... 366/318; 366/279; 366/343; 366/605

[58] Field of Search ..... 366/129, 130, 310, 279, 366/318-324, 342-344, 605; 416/176

[56] References Cited

U.S. PATENT DOCUMENTS

| | | | |
|---|---|---|---|
| 2,733,900 | 2/1956 | Wobensmith | 366/605 X |
| 4,407,584 | 10/1983 | Boudin et al. | 366/605 X |
| 4,472,063 | 9/1984 | Eickelmann | 366/605 X |

*Primary Examiner*—Timothy F. Simone
*Attorney, Agent, or Firm*—Rogers, Howell, Renner, Moore & Haferkamp

[57] ABSTRACT

A portable mixing device particularly for use with power drills or the like, having a helicoidal flight of coil units of equal dimensions leading up from a bottom, that has a radial edge to scrape material off the bottom of a can and a rounded corner that prevents the edge from cutting into a can, the several coils of helixes terminating at the top in another radial edge with a rounded corner to prevent cutting into the side of the can, with a circular baffle plate spaced a predetermined distance above the top edge of the helical flight to deflect the material being stirred upwardly by the device, outwardly to that it can then circulate back downwardly to effect the mixing circulation.

6 Claims, 5 Drawing Figures

PORTABLE MIXING DEVICE

BACKGROUND AND OBJECTS OF THE INVENTION

The present invention relates to a mixer that is usable for such things as mixing paints, cement, pastes, driveway sealers, roofing materials, epoxy compounds and the like. It is adapted to be attached to a power drill or the like driving device to be held in the hand of the user.

Helicoidal mixing devices are known as, for example, in the Neumann U.S. Pat. No. 4,199,269, although this particular one is not suitable for present purposes. A helicoidal garden auger is shown in my U.S. Pat. No. 3,356,168. A helical mixer is shown in Wobensmith U.S. Pat. No. 2,733,900, for use with a power drill. However, the present invention uses helicoidal flights rather than a helically coiled rod and uses coil units extending in a single direction rather than in alternate directions. Also, the Wobensmith device does not have means to prevent cutting into the bottom or side of the can.

The present device is designed so that it will not cut into the can at the side of the can or at the bottom thereof. It can scrape the bottom of the can because of the radial edge at the bottom, as distinguished from the Wobensmith rod-like device provides a full scraping edge. Also by the uniform width of the flight coil units, the present device can scrape the sides of the can completely.

This device is also arranged so that it will not throw the material being mixed up out the top of the can, but rather will deflect it outwardly and back so that it can be circulated and thoroughly mixed as distinguished from what could be done with the prior art.

DESCRIPTION OF PREFERRED EMBODIMENT

Figure 1:
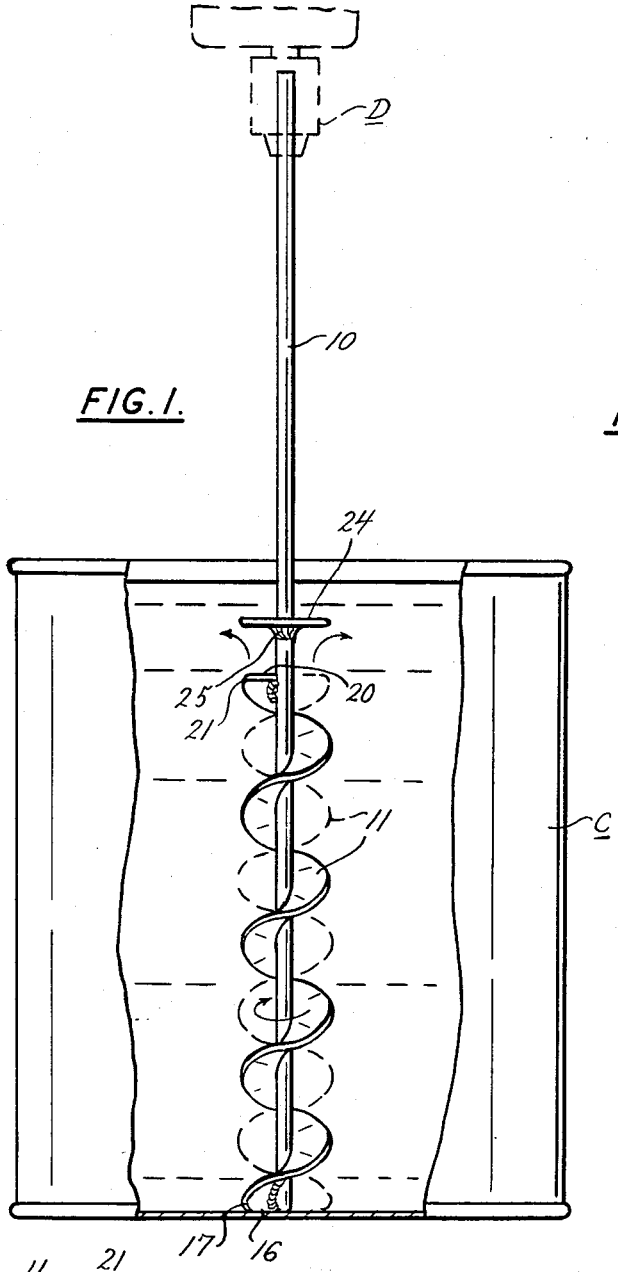
FIG. 1 is an elevation of the mixer in a can, and shown in rotation.
Figure 2:
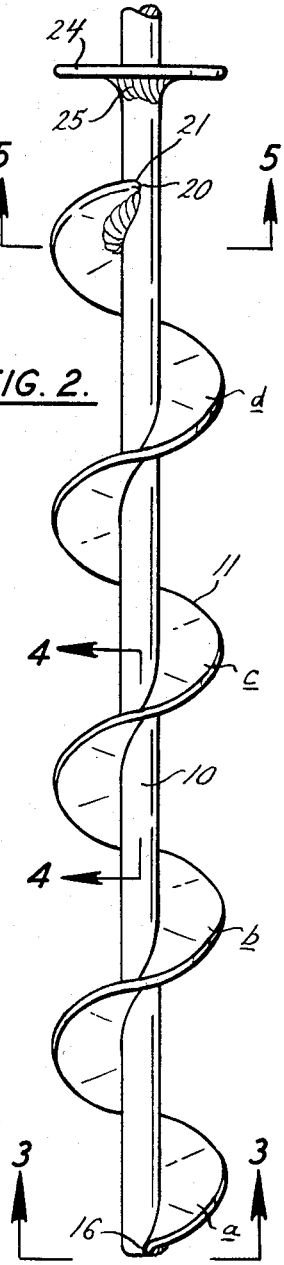
FIG. 2 is an elevational view of the working end of the mixer taken at right angles to FIG. 1.

In the drawings, C represents a can, as for example a paint can. The present mixer comprises a vertical shaft 10, the upper end of which may be fitted into a chuck of a hand drill D. The lower end of this shaft 10 has a helicoidal (i.e., generated by a line extending outward from the axis, and displaced along the axis by a uniform abount for each degree of angular movement around the axis) flight generally indicated at 11. Four coil units a, b, c and d are shown in FIG. 1, although the number of coil units is chosen to suit the type of usage on the mixer. The flight coils project outwardly from the shaft 10, the shaft being sufficiently large in diameter to provide adequate strength. The outward extent of the blades is enough to give them scope to stir the contents of a can such as a can C without imposing too great a load on the motor of the hand drill D.

The bottom coil unit a comes down to a radial edge 16 that is horizontal and perpendicular to the axis of the shaft 10 and preferably is at the lowermost point of the device. The outer corner of this edge 16 is rounded at 17 so that it cannot cut into the bottom of the can. Furthermore, if the stirring mixer is moved over to the side of the can and is held at an angle to the side, the rounded corner 17 will prevent the device from cutting into the wall of the can.

Figure 5:
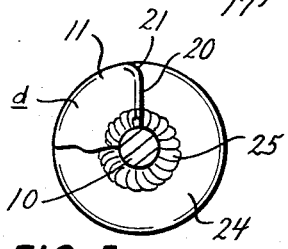
FIG. 5 is a view approximately on the line 5—5 of FIG. 2.
Figure 4:
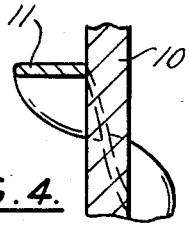
FIG. 4 is a section on the line 4—4 of FIG. 2.
Figure 3:
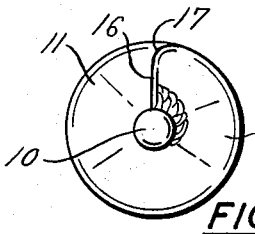
FIG. 3 is a bottom view taken along the line 3—3 of FIG. 2.

The upper end of the flight 11 likewise has a radial edge 20 that has a rounded corner 21 as shown in FIG. 5. This rounded corner 21 likewise prevents cutting into the side of the can in the event the devices reaches that point.

Spaced above the top of the flight 11 is a baffle 24. This baffle is in the form of a circular disk welded by a tapered weld 25 to the shaft 10. The distance from the baffle 24 down to the bottom of the device is preferably somewhat less than the depth of the can in which the material to be mixed is placed. It is, of course, desirable to have the baffle submerged. But on the other hand, it is desirable to have it near the upper surface so that a maximum amount of stirring can be obtained. Also the baffle should be a determinable distance above the top of the flight and its edge 20 to enable the liquid to be ejected upwardly from the flight of coils.

Typical dimensions may be as follows. To mix contents of one or five gallon cans (71 l.), a home owner's model may have $1\frac{1}{8}''$ (2.9 cm.) outside diameter to fit any $\frac{1}{4}''$ (0.72 cm.) electric drill. It can have a shaft $\frac{1}{4}''$ (0.72 cm.) in diameter, 15" (37.7 cm) long, and can have 7" (17.7 cm.) of mixing action; i.e., the distance from the baffle to the bottom of the flight. A large contractor's model for heavier duty work can have $1\frac{1}{2}''$ (3.8 cm.) outside diameter, to fit any $\frac{3}{8}''$ (0.95 cm.) electric drill, a 5/16" (0.79 cm.) shaft, 24" (61 cm.) long such as for five gallon (18.9 l.) cans with $11\frac{1}{2}''$ (29.2 cm.) of mixing action. The distance between the top of the flight and its edge 20 to the baffle can be about 13/16 inches (2.05 cm).

OPERATION OF THE DEVICE

Assuming that the device is connected into an electric hand drill and the can opened at the top, it can be inserted into the material of the can before the drill is started. Then when it hits the bottom of the can and is held as nearly vertical as possible, the drill is started, turning the auger in a direction to "screw" the material upwardly and out toward the baffle 24. Approaching and striking the baffle causes the material to move outwardly.

The fact that the auger has several coil units of equal diamensions, here shown as four complete units a through d, assures that the material will be driven continuously upwardly and out the top. The baffle then forces it outwardly, whence it moves downwardly to fill the space left by the upwardly moving material. The baffle must be far enough above the flight 11 to permit the free exiting of the material upwardly and laterally, a condition that would not be effective if the baffle were too close to, or was, resting upon the flight.

As noted, the device can be moved around in the can without damaging the can and thereby can scrape up material from the bottom at all points in the bottom. Because of the rounded curves of both ends of the flight, the flight will not cut into the bottom or sides of the can. Because of the even sizing of the units of the flight 11, the device can be brought literally against the sides of the can without damage to either it or to the can, thereby scraping the sides clean. With the baffle 24 below the top of the can, the material will not be thrown out of the top.

The device will also work when the can is only partly filled. In that case, the upward circulation is produced by the auger arrangement of the flight and the circulation, although not as good as that with a full can and the baffle in action, nevertheless will take place, causing mixing of the material.

To prevent spatter, the drill should be stopped before it is removed from the container.

Some cans of paint, particularly those of the five-gallon size are provided with a so-called bung hole in the top. It consists of a hole about two inches in diameter that is normally capped. When it is uncapped, the present mixer can be inserted through it and then caused to stir the contents of the can. This condition is made possible by the fact that the device has a maximum radial dimension throughout, that is less than the normal size of the bung hole. This is a considerable advantage over most mixers that, by the nature of their construction, cannot be inserted through the opening. With such an arrangement, the stirring of the contents can be done without significant possibility of having the contents of the can surged out the top of the can during the stirring operation.

What I claim is:

1. A mixer having a center shaft adapted to be vertically disposed in a receptacle of material to be mixed, a helicoidal flight of a plurality of coil units arranged about and extending outwardly from the center shaft, the lowermost coil unit at the bottom of the device having a substantially radial edge that extends outwardly from the shaft and that is horizontal, and having an outer corner rounded so as to reduce a tendency to cut into the receptacle, the upper end of the flight having a terminal edge that extends outwardly from the shaft and is substantially radial and with its outer corner rounded to avoid cutting into the receptacle, a baffle disk centered on the shaft and spaced above the upper terminal edge of the flight, the baffle disk and the flights providing an opening above the flight toward which the flight can direct the material being stirred and the baffle disk being adapted to deflect the said material outwardly from the shaft.

2. The mixer of claim 1 wherein the flight has coil units of the same dimension from top to bottom and wherein the baffle is circular and has a radius equal to the radius forming the helicoidal flights.

3. The mixer of claim 2, wherein the baffle is flared outwardly on its underside to deflect the material outwardly.

4. The device of claim 2 wherein the center axis of the device comprises a rod that terminates at the bottom with the edge of the coil unit thereat and which extends above the baffle at the top an appropriate distance to be engaged by a hand driving device or the like.

5. The device of claim 1 wherein the helicoidal flight is formed by the locus of a radial line transverse to the axis that moves along the axis the same distance per angular movement about the axis, from the top to the bottom of the flight.

6. The mixer of claim 2 wherein the maximum diametrical dimension from top to bottom of the mixer is less then the normal diameter of a bung hole in the top of a paint can, whereby the mixing may be done with this mixer with the pain can cover still on and only the bung hole opened.

* * * * *